US006525285B2

(12) United States Patent
Kudo et al.

(10) Patent No.: US 6,525,285 B2
(45) Date of Patent: Feb. 25, 2003

(54) LEVER SWITCH AND DETECTING DEVICE USING SAME

(75) Inventors: Yasuchika Kudo, Fukui (JP); Kenji Yasufuku, Kyoto (JP); Yusho Nakase, Fukui (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 70 days.

(21) Appl. No.: 09/748,877

(22) Filed: Dec. 27, 2000

(65) Prior Publication Data

US 2001/0025780 A1 Oct. 4, 2001

(30) Foreign Application Priority Data

Dec. 27, 1999 (JP) ..... 11-369844

(51) Int. Cl.[7] ..... H01H 21/82

(52) U.S. Cl. ..... 200/559; 200/559; 200/530; 200/531; 200/536

(58) Field of Search ..... 200/559, 530, 200/531, 536, 160, 6 R, 557

(56) References Cited

U.S. PATENT DOCUMENTS 3,591,747 A 7/1971 Dennison
5,099,091 A 3/1992 Kokubu
5,350,893 A 9/1994 Yamauchi et al.
5,369,238 A * 11/1994 Hirata ..... 200/530
5,473,130 A 12/1995 Pudims
5,796,058 A * 8/1998 Aimi ..... 200/16
6,248,966 B1 * 6/2001 Nakase et al. ..... 200/557
6,262,961 B1 * 7/2001 Maeda et al. ..... 369/77.2

FOREIGN PATENT DOCUMENTS

EP 0 604 331 A1 * 12/1992

* cited by examiner

*Primary Examiner*—Elvin Enad
*Assistant Examiner*—Jennifer A. Poker
(74) *Attorney, Agent, or Firm*—RatnerPrestia

(57) ABSTRACT

A lever switch includes a case, and a stationary contact, common contact, movable contact and lever which are disposed in the case. The movable contact is made up of elastic metal and includes a stationary portion, contact portion, and a curved portion located between the stationary portion and the contact portion. The stationary portion is connected to the common contact. The movable contact is disposed in a state of bending so that the contact portion may come in contact with or apart from the stationary contact. An operating portion is protruded from an opening, and a driving portion is located inside the case and abuts on the curved portion of the movable contact. When the operating portion is manipulated, the driving portion pushes the curved portion, and then the contact portion comes in contact with or apart from the stationary contact.

22 Claims, 11 Drawing Sheets

LEVER SWITCH AND DETECTING DEVICE USING SAME

FIELD OF THE INVENTION

The present invention relates to a lever switch used for various electronic components and also to a detecting device using the lever switch.

BACKGROUND OF THE INVENTION

A lever switch used for various electronic components is employed for the purpose of detecting the presence of a recording medium such as a tape and disc or the operation of a mechanism. As a lever switch used for the purpose of such detection, a leaf switch having a combination of a movable contact and a stationary contact which are made up of elastic sheet metal is well known.

With respect to such conventional switch, the description will be given in the following with reference to FIG. 13 and FIG. 14.

FIG. 13 is a side sectional view of a conventional lever switch. In FIG. 13, the lever switch comprises a box-type case 1 and a lever 2. The case 1 comprises an opening formed in front and an opening 1A formed at the left side. The case 1 is made of insulating resin. In the middle of a lever 2 is formed an axle portion 2A, and the axle portion 2A is rotatably retained in the case 1. A driving portion 2B at one end of the lever 2 is located within the case 1, and an operating portion 2C at the other end of the lever is protruded diagonally up to the left from the opening 1A of the case 1.

Each of a movable contact 3 and a stationary contact 4 which are made up of elastic sheet metal is embedded in an inner right-hand wall 1B opposed to the opening 1A of the case 1. The left end of the movable contact 3 elastically comes in contact with the top of the driving portion 2B of the lever 2 to move the operating portion 2C diagonally up to the left. Further, there is provided a contact portion 4A slightly curved at the left end of the stationary contact 4 opposed to the middle portion of the movable contact 3.

The front of the case 1 storing the movable contact 3 and stationary contact 4 therein is provided with a cover (not shown).

In the above configuration, when the operating portion 2C of the lever 2 is moved downward with a predetermined force, the driving portion 2B will rotate upward on the axle 2A, as shown in the side sectional view of FIG. 14. Accordingly, the left end portion of the movable contact 3 bends upward as it is pushed by the top of the driving portion 2B, and then the movable contact 3 will come into contact with the stationary contact portion 4A of the stationary contact 4.

When the operating portion 2C of the lever 2 is rotated only for a predetermined stroke, the left end portion of the movable contact 3 further moves upward. The middle portion of the movable contact 3 then pushes the contact portion 4A, and due to the pressure, the stationary contact 4 also bends upward. In this way, the movable contact 3 and stationary contact 4 come in contact with each other under a stable pressure.

When the operating force applied to the operating portion 2C of the lever 2 is released, the driving portion 2B will be pressed downward due to the elasticity of the movable contact 3 and stationary contact 4, thereby causing the lever 2 to be rotated and the operating portion 2C to be shifted back to the status of FIG. 13.

However, in a conventional lever switch as described above, the movable contact 3 is moved in the direction of switch height by the lever 2, making the movable contact 3 to come in contact with and apart from the stationary contact 4, and therefore, the switch is required to have a predetermined height equivalent to the movement of the movable contact 3. This makes it difficult to miniaturize the entire switch. Further, since a stable contact pressure is obtained between the stationary contact 4 and movable contact 3 when the stationary contact 4 also bends after movement of the lever 2 only for a predetermined stroke, these contacts are not in stable contact with each other when the lever 2 is halfway in operation.

SUMMARY OF THE INVENTION

A lever switch of the present invention comprises (a) a case having an opening;

(b) a stationary contact disposed in the case;

(c) a common contact disposed in the case;

(d) a movable contact disposed in the case; and (e) a lever having an operating portion and a driving portion, wherein the movable contact is made of elastic metal, the movable contact includes a stationary portion, a contact portion, and a curved portion located between the stationary portion and the contact portion, the stationary portion is connected to the common contact, and the movable contact is disposed in a state of bending so that the contact portion is able to be in contact or non-contact with the stationary contact.

Wherein the operating portion is protruded from the opening, the driving portion is located inside the case and is abutting on the curved portion of the movable contact, and when the operating portion is manipulated, the driving portion pushes the curved portion, and then the contact portion comes into contact with or apart from the stationary contact.

A detecting device of the present invention comprises a casing;

a lever switch disposed in the casing;

a detection circuit electrically connected to the lever switch; and a moving body inserted and detachably installed in the casing.

The lever switch has the same configuration as described above. When the moving body is inserted into the casing, the moving body acts upon the operating portion of the lever.

With the above configuration, it is possible to obtain a miniature lever switch reduced in thickness and size. Further, a lever switch assuring electrically stable contact can be obtained. Thus, the effects of such miniaturization and stabilization can be obtained at the same time. Moreover, it is possible to realize the miniaturization and stabilization of a detecting device by using such lever switch. Also, the detecting device is able to reliably detect the operation of the moving body.

DESCRIPTION OF THE MARKS

Figure 1:
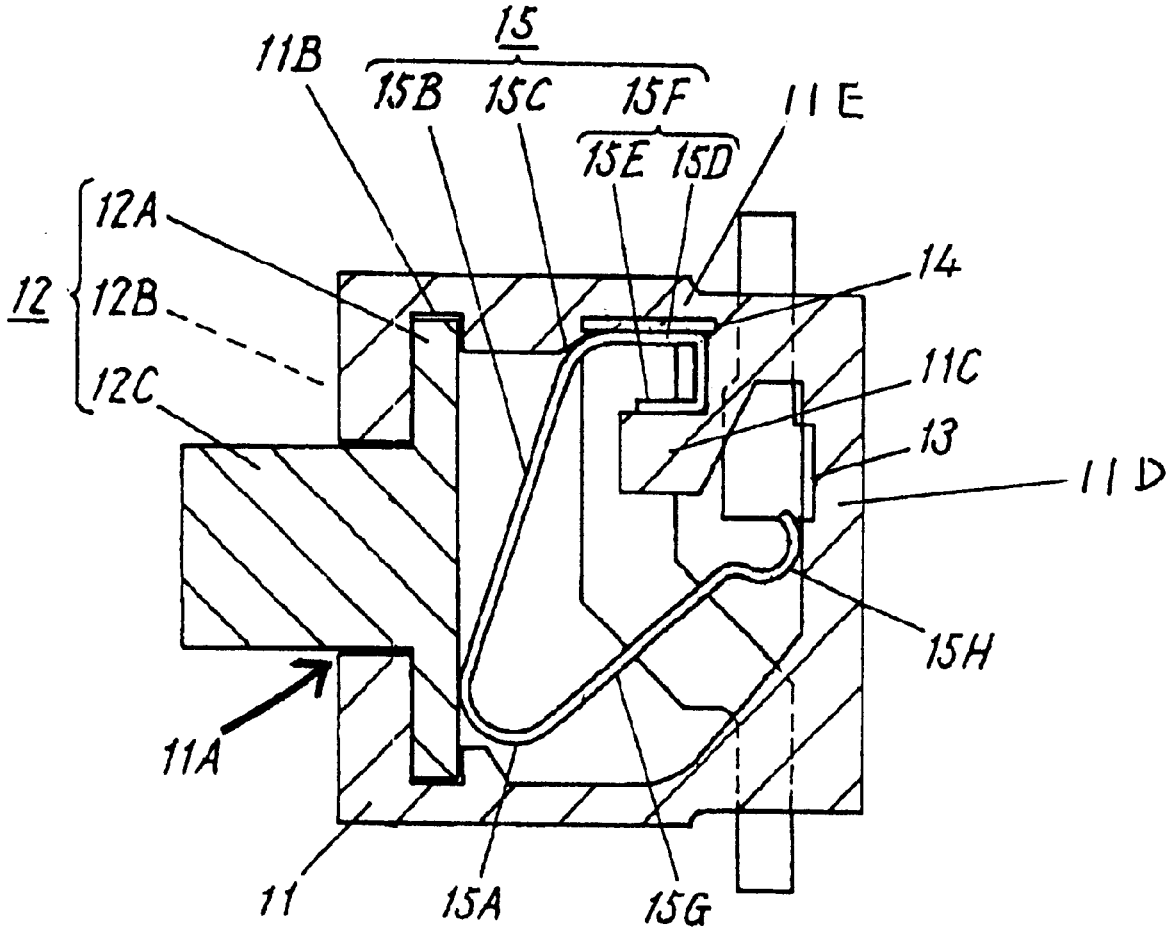
FIG. 1 is a top sectional view of a lever switch in a first exemplary embodiment of the present invention.

| | |
|---|---|
| 11, 21 | Case |
| 11A, 21A | Opening, first opening |
| 11B, 21B | Rotation holding portion |
| 11C, 21C | Support portion |
| 11D | First inner wall, right-hand inner wall |
| 11E | Second inner wall, upper inner wall |
| 12 | Lever |
| 12A | Axle portion |
| 12B | Driving portion |
| 12C | Operating portion |
| 13 | Stationary contact |
| 14 | Common contact |
| 15, 24 | Movable contact |
| 15A | Curved portion |
| 15B, 24B | First arm portion |
| 15C | Bend |
| 15D | Connecting portion |
| 15E | Abutment |
| 15F, 24A | Stationary portion |
| 15G, 24C | Second arm portion |
| 15H | Contact portion |
| 15J, 15K | Elastic tongue |
| 16, 23 | Cover |
| 22 | Rotary cam |
| 22A | Fulcrum portion |
| 22B | Projection |
| 30 | Lever switch |
| 31 | Casing |
| 31A | Cavity |
| 32 | Detection circuit |
| 33 | Moving body |

DETAILED DESCRIPTION OF THE INVENTION

A lever switch in accordance with an exemplary embodiment of the present invention comprises (a) a case having an opening, (b) a stationary contact disposed in the case, (c) a common contact disposed in the case, and (d) a movable contact disposed in the case, wherein the movable contact is made of elastic metal, and the movable contact includes a stationary portion, a contact portion, and a curved portion located between the stationary portion and the contact portion, the stationary portion is connected to the common contact, and the movable contact is disposed in a state of bending so that the contact portion is able to come in contact with and apart from the stationary contact, and (e) a lever having an operating portion and a driving portion, wherein the operating portion is protruded from the opening, and the driving portion is located inside the case and is abutting on the curved portion of the movable contact, wherein when the operating portion is manipulated, the driving portion pushes the curved portion, and then the contact portion comes into contact with or apart from the stationary contact.

With the above configuration, it is possible to obtain a miniature lever switch reduced in thickness and size. Further, a lever switch assuring electrically stable contact can be obtained. Thus, the effects of such miniaturization and stabilization can be obtained at the same time.

Preferably, the case further comprises a box-type shape having a first inner wall opposed to the opening and a second inner wall adjacent to the first inner wall, wherein the stationary contact is disposed on the first inner wall, and the common contact is disposed on the second inner wall.

Preferably, the case further comprises a support portion and second inner wall; the support portion is formed at a position spaced apart from the second inner wall as predetermined; the stationary portion includes a small U-shape having a connecting portion and abutment; the connecting portion is connected to the common contact; and a stationary portion having the small U-shape is disposed between the common contact and the support portion.

Preferably, the movable contact includes a general U-shape; the movable contact further comprises a first arm portion between the stationary portion and the curved portion and a second arm portion between the contact portion and the curved portion; when the driving portion pushes the curved portion, at least one of the first arm portion and the second arm portion will bend; and due to bending of at least one of the first arm portion and the second arm portion, the contact portion comes into contact with or apart from the stationary contact.

Preferably, the lever further comprises an axle portion between the operating portion and the driving portion, and the axle portion is retained in the case and is rotatable in a direction parallel to the stationary contact.

Preferably, the movable contact has a shape of thin strip; the contact portion has a semi-circular curvature surface; and the curvature surface is able to make contact with the stationary contact.

Preferably, the stationary contact is built into the inner wall of the case so that the surface of the stationary contact is same in height as the inner wall surface of the case, and when the operating portion is manipulated, the contact portion will slide on at least one of the plate-type stationary contact surface and the inner wall surface.

Preferably, the lever switch is further provided with a cover; the case further includes a second opening; the case is formed in one piece; and the cover is disposed so as to cover the second opening.

Preferably, the case further includes a rotation holding portion, and the lever is rotatably held by the rotation holding portion.

Each of the above configurations will further bring about additional advantages.

Preferably, the movable contact further includes an elastic tongue extending from the stationary portion, and the elastic tongue is abutting on the first arm portion so that the tip of the elastic tongue pushes the first arm portion.

In this configuration, when the movable contact pushes the driving portion of the lever to return the operating portion, the force will be increased by the elastic tongue abutting on the first arm portion. Accordingly, it is possible to precisely return the operating portion of the lever even in case the movable contact is less in width or thickness.

Preferably, the movable contact further comprises an elastic tongue of general U-shape that extends from the stationary portion, and the elastic tongue is abutting on the second arm portion so that the tip of the elastic tongue pushes the second arm portion.

In this configuration, when the contact portion of the movable contact elastically comes into contact with the inner wall of the case or the stationary contact, the contact pressure will be increased by the elastic tongue abutting on the second arm portion. Thus, it is possible to establish stable contact between the contacts.

Preferably, the lever switch further comprises a rotary cam disposed between the lever and the movable contact, wherein one end of the rotary cam is rotatably retained in the case; the surface of the rotary cam comes in contact with the driving portion of the lever; the back of the rotary cam comes in contact with the curved portion of the movable contact; and when the operating portion is manipulated, the driving portion pushes the rotary cam while the rotary cam with its end retained as described pushes the curved portion, and then, the contact portion comes into contact with or apart from the stationary contact.

In this configuration, due to the rotary cam rotatably retained in the case, it is possible to precisely operate the movable contact even in case the driving portion of the lever is less in movement. Accordingly, it is possible to obtain a miniature switch reduced in thickness and size.

Preferably, the rotary cam has a projection formed thereon, and the projection comes into contact with the driving portion of the lever.

Preferably, the movable contact has a wire shape, and the stationary portion has an unwinding coil spring. In this configuration, even in case the first arm portion and the second arm portion of the movable contact are short in length, a sufficient contact pressure against the stationary contact and return force may be attained due to the stationary portion provided with the unwinding coil spring. Accordingly, it is possible to make the movable contact smaller in size and to miniaturize the switch.

A detecting device in accordance with an exemplary embodiment of the present invention comprises a casing; a lever switch disposed in the casing; a detection circuit electrically connected to the lever switch; and a moving body inserted and detachably disposed in the casing so as to operate the stationary portion of the lever, wherein the lever switch has the same configuration as described above, and when the moving body is inserted into the casing, the moving body acts upon the operating portion of the lever.

Preferably, the moving body includes at least one of those selected from a group of a cassette tape, disc and mechanism.

In this configuration, it is possible to detect the presence of a recording medium such as a tape and disc or the operation of mechanism. Further, it is possible to obtain a detecting device that gives rise to miniaturization of the switch.

A lever switch in accordance with an exemplary embodiment of the present invention comprises (a) a case having an opening and a support portion,
wherein the case has a box-type shape including a first inner wall opposed to the opening and a second inner wall adjacent to the first inner wall, and the support portion is formed at a position spaced apart from the second inner wall as predetermined;

(b) a stationary contact disposed within the case,
wherein the stationary contact is installed on the first inner wall;

(c) a common contact disposed within the case,
wherein the common contact is installed on the second inner wall;

(d) a movable contact disposed in a state of bending within the case,
wherein the movable contact is made of elastic sheet metal and has a general U-shape;
the movable contact includes a stationary portion secured to the case, a contact portion, a curved portion between the stationary portion and the contact portion, a first arm portion between the stationary portion and the curved portion, and a second arm portion between the contact portion and the curved portion;
the contact portion is able to come in contact with at least one of the stationary contact and the first inner wall;
the stationary portion has a general U-shape and is press-fitted between the common contact and the support portion;
the stationary portion comes into contact with the common contact; and (e) a lever having an operating portion, an axle portion and a driving portion, wherein the operating portion is protruded from the opening, the axle portion is rotatably retained in the case in a parallel fashion with the stationary contact, and the driving portion is located in the case and abutting on the curved portion of the movable contact,
wherein when the operating portion is manipulated, the driving portion pushes the curved portion, and then the contact portion comes into contact with or apart from the stationary contact.

In this configuration, the movable contact pushed by the driving portion of the lever moves in a direction perpendicular to the operating direction of the lever operating portion. Accordingly, the entire switch may be reduced in thickness. Further, the stationary portion is press-fitted between the common contact and support portion, and the contact portion of the movable contact being in a state of slightly bending in advance elastically slides on the inner wall of the case or the stationary contact thereby coming in contact with and apart from the stationary contact. Thus, a constant contact pressure can be maintained at the contacts even when the lever is halfway in operation. As a result, it is possible to obtain a lever switch which assures stable contact at all times.

Exemplary embodiments of the present invention will be described in the following with reference to FIG. 1~FIG. 12.

EXEMPLARY EMBODIMENT 1

Figure 2:
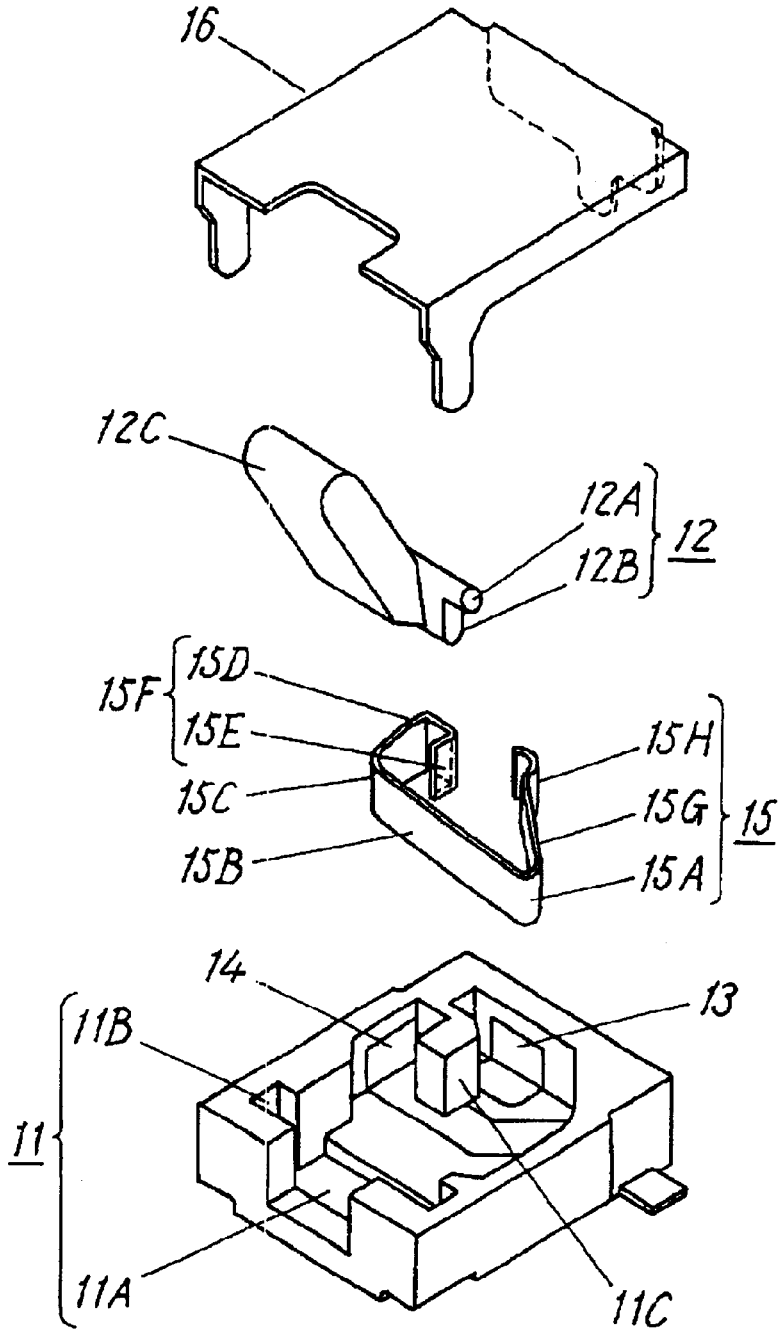
FIG. 2 is an exploded view of a lever switch in a first exemplary embodiment.
Figure 3:
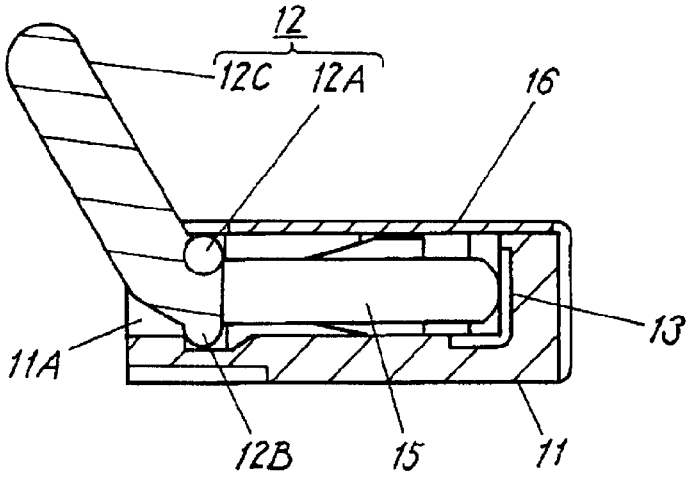
FIG. 3 is a side sectional view of a lever switch in a first exemplary embodiment.

FIG. 1 is a top sectional view of a lever switch in the exemplary embodiment 1 of the present invention. FIG. 2 is an exploded view of the lever switch, and FIG. 3 is a side sectional view of the lever switch. In these figures, the lever switch comprises a case 11, a lever 12, a stationary contact 13, a common contact 14, a movable contact 15, and a cover 16.

The case 11 is made up of insulating resin. The case 11 has a box-type shape, including a second opening formed in front and a first opening 11A formed at the left-handside. The lever 12 has an axle portion 12A. The axle portion 12A is formed in the middle of the lever 12. The axle portion 12A is rotatably held by the rotation holding portion 11B of the case 11. A driving portion 12B at one end of the lever 12 is stored in the case 11 and an operating portion 12C at the other end of same is protruded diagonally up to the left from the first opening 11A. The cover 16 is disposed so as to cover the second opening of the case 11.

The stationary contact 13 is made up of conductive metal. Preferably, the stationary contact has a plate shape. The stationary contact 13 is embedded in a right-hand inner wall 11D being a first inner wall opposed to the first opening 11A of the case 11. That is, the stationary contact is embedded in the inner wall in a manner such that the surface of same is exposed. Preferably, the surface of the stationary contact is same in height as the surface of the inner wall 11D and there is no level difference between the stationary contact surface and the inner wall surface. The common contact 14 is made up of conductive metal. The common contact 14 is embedded in an upper inner wall 11E being a second inner wall. The case 11 has a support portion 11C, and the support portion 11C opposed to the common contact 14 is formed in a position spaced apart from the common contact as predetermined.

The movable contact 15 is made up of elastic sheet metal and has a general U-shape. The movable contact 15 is stored in the case 11 in a state of slightly bending. The movable contact 15 comprises a curved portion 15A, first arm portion 15B, bend 15C, stationary portion 15F, second arm portion 15G and contact portion 15H. The stationary portion 15F includes a connecting portion 15D and abutment 15E. The curved portion 15A is located in the middle of the movable contact. The curved portion 15A elastically comes in contact with the driving portion 12B of the lever 12. The first arm portion 15B extends from one end of the curved portion 15A. At the end of the first arm portion 15B is formed the stationary portion 15F via the bend 15C, and the stationary portion 15F has a general U-shape. The connecting portion 15D elastically comes in contact with the common contact 14, and the abutment 15E elastically comes in contact with the support portion 11C of the case 11 while the stationary portion 15F being in a state of slightly bending is press-fitted between the common contact 14 and support portion 11C.

The second arm portion 15G extends from the other end of curved portion 15A of movable contact 15. At the end of the second arm portion 15G is formed the contact portion 15H. The contact portion 15H elastically comes in contact with the right-hand inner wall 11D of the case 11.

The lever 12 supported on axle portion 12A is retained in the case 11 and can be vertically operated in a parallel fashion with the right-hand inner wall of the case 11. Thus, the lever switch has a configuration as described.

Figure 4:
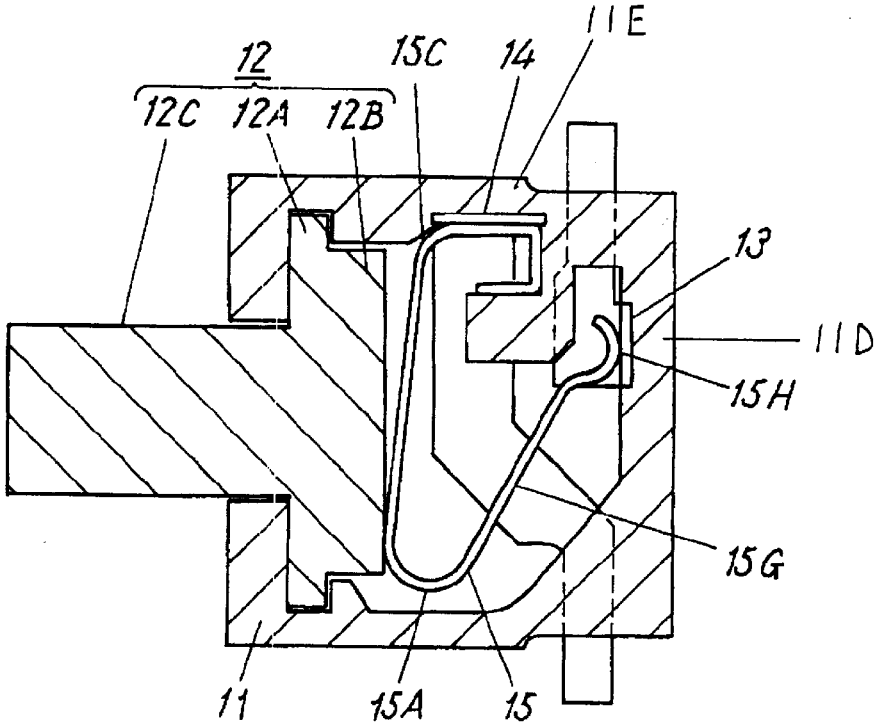
FIG. 4 is a top sectional view of a lever switch in operation mode in a first exemplary embodiment.

In the above configuration, when the operating portion 12C of the lever 12 in FIG. 3 is moved downward with a predetermined force, the driving portion 12B supported on the axle 12A will move to the right as shown in the top sectional view of FIG. 4. The movement of the driving portion 12B pushes the curved portion 15A of the movable contact 15. As the curved portion 15A is pushed, the movable contact 15 supported on the bend 15C bends and moves to the right in a direction perpendicular to the operating direction of the operating portion 12C. Due to the movement of the movable contact 15, the contact portion 15H at the end of the second arm portion 15G elastically slides upward on the right-hand inner wall of the case 11 to come into contact with the stationary contact 13. In this way, the stationary contact 13 and common contact 14 will be electrically connected to each other via the movable contact 15.

When the operating force to the operating portion 12C of the lever 12 is released, the contact portion 15H elastically slides downward on the right-hand inner wall 11D of the case 11 due to the elasticity of the movable contact 15 and comes apart from the stationary contact 13. Further, the driving portion 12B is then pushed by the curved portion 15A, causing the lever 12 to rotate, and then the operating portion 12C will return to the status of FIG. 1 and FIG. 3.

Thus, in accordance with the present exemplary embodiment, since the movable contact 15 pushed by the driving portion 12B of the lever 12 moves in a direction perpendicular to the operating direction of the operating portion 12C of the lever 12, it is possible to make the entire switch lower in height. That is, the reduction in thickness of the lever switch may be realized. Further, the stationary portion 15F of the movable contact 15 is press-fitted between the common contact 14 and the support portion 11C, and the contact portion 15H being in a state of bending in advance elastically slides on the right-hand inner wall 11D of the case 11 or on the stationary contact 13, making the movable contact 15 and stationary contact 13 come into contact with or apart from each other, and thereby, it is possible to keep the contact pressure constant at all times even when the lever 12 is halfway in operation. Accordingly, the lever switch obtained will assure stable contact between the movable contact 15 and the stationary contact 13.

Preferably, the contact portion 15H includes a semi-circular curvature surface, and the curvature surface is able to make contact with the stationary contact. This configuration will bring about additional advantages.

Figure 5:
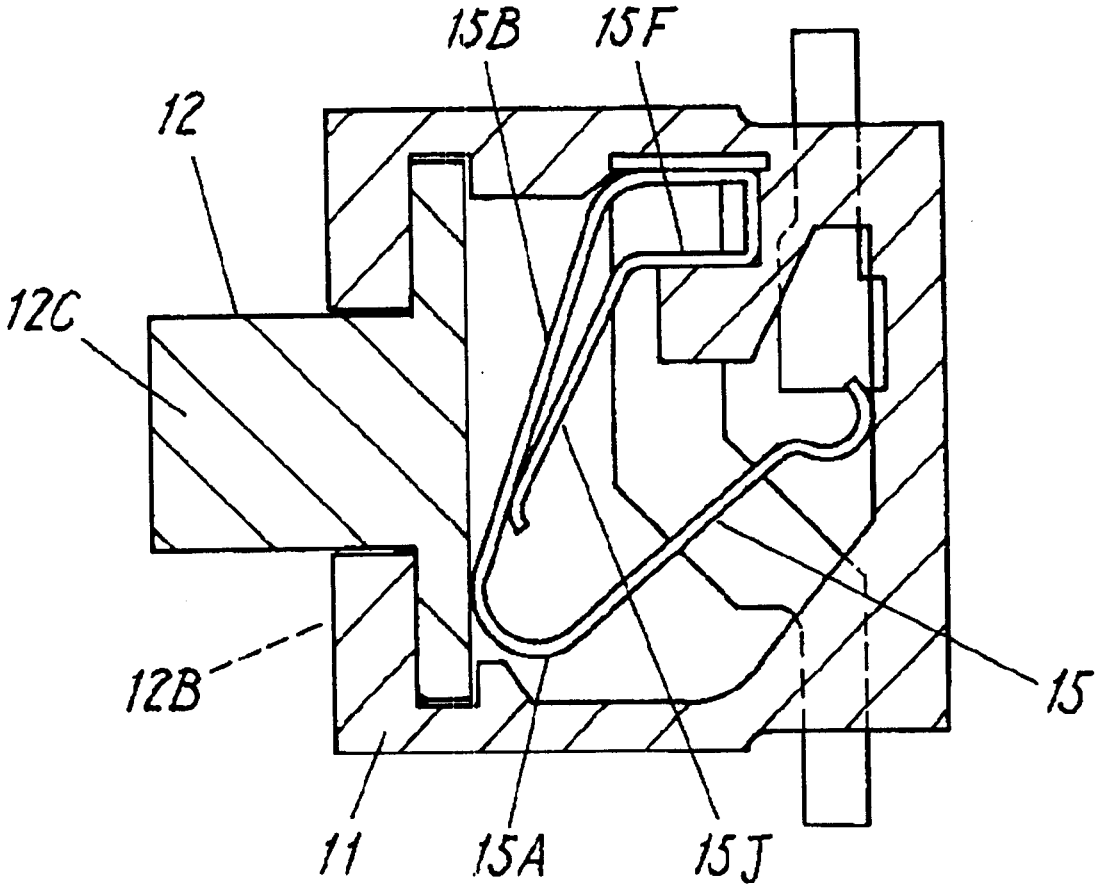
FIG. 5 is a top sectional view of a lever switch provided with an elastic tongue in a first exemplary embodiment.

Preferably, as shown in the top sectional view of FIG. 5, the movable contact 15 has an elastic tongue 15J extending from the stationary portion 15F. The elastic tongue 15J is formed in one piece with the stationary portion 15F. The end of the elastic tongue 15J is abutted on the inner side of the first arm portion 15B. In this way, the curved portion 15A of the movable contact 15 pushes the driving portion 12B of the lever 12. Thus, the force to return the operating portion 12C will be increased. Accordingly, the operating portion 12C of the lever 12 may be precisely returned even when the movable contact 15 is less in width or thickness.

Figure 6:
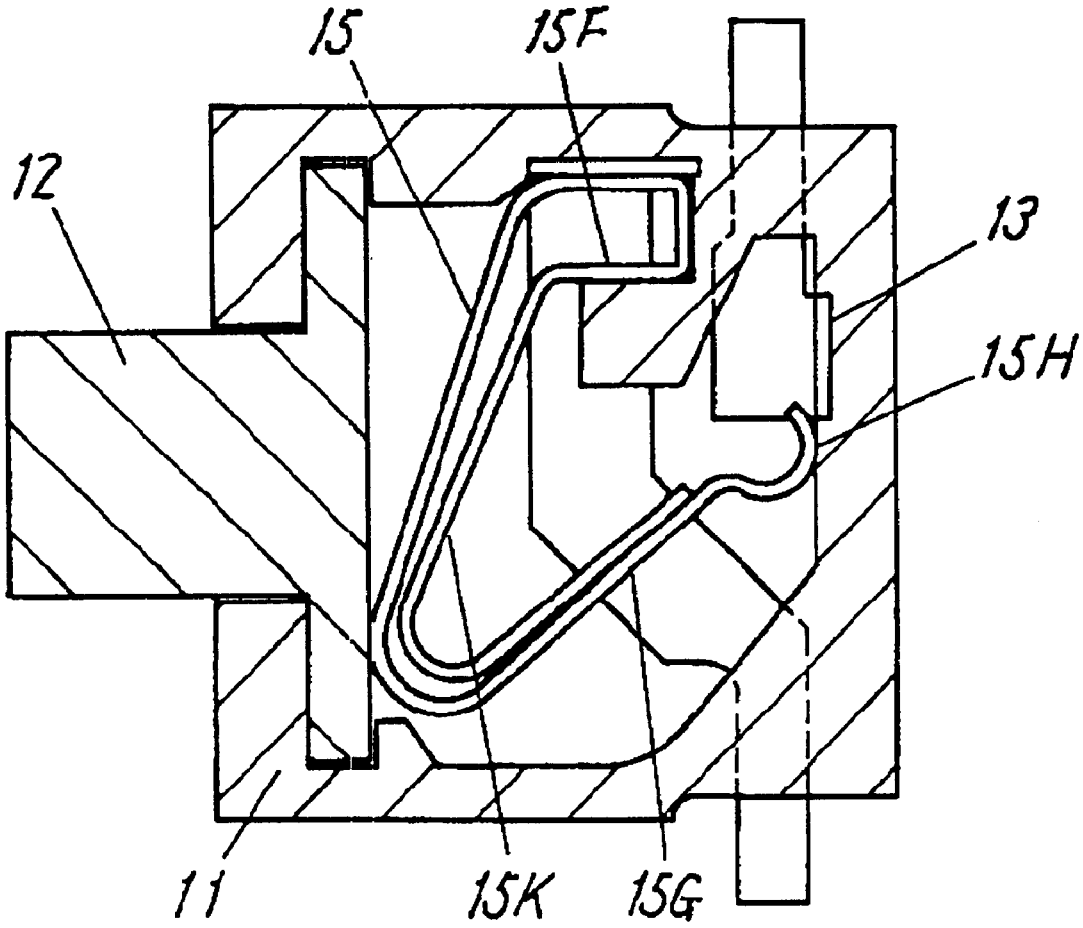
FIG. 6 is a top sectional view of a lever switch provided with an elastic tongue in a first exemplary embodiment.

Preferably, as shown in the top sectional view of FIG. 6, the movable contact 15 has a generally U-shaped elastic tongue 15K extending from the stationary portion 15F. The elastic tongue 15K is formed in one piece with the stationary portion 15F. The end of the elastic tongue 15K is abutted on the inner side of the second arm portion 15G. Thus, the contact pressure will be increased when the contact portion 15H of the movable contact 15 elastically comes in contact with the right-hand inner wall 11D of the case 11 or with the stationary contact 13. Accordingly, it is possible to further greatly stabilize the contact between the movable contact 15 and the stationary contact 13.

In the present exemplary embodiment, when the operating portion 12C of the lever 12 is rotated, the contact portion 15H of the movable contact 15 elastically being in contact with the right-hand inner wall of the case 11 comes into contact with the stationary portion 13. That is, the above lever switch is a push-on type switch. Thus, the lever switch of the present invention is not limited in terms of configuration, and it is also possible to employ a configuration as follows. For example, the contact portion 15H electrically connected to the stationary portion 13 in advance may be electrically disconnected when the operating portion 12C of the lever 12 is rotated to make the movable contact 15 come apart from the stationary contact 13. It is also possible to realize a push-on type switch of this kind.

In the above embodiment, the first inner wall 11D, second inner wall 11E, support portion 11C, rotation holding portion 11B, first opening 11A and second opening are formed in one body, which form the case 11. The present invention is not limited to this configuration, and a configuration formed by combining different members in various ways is also possible, but such configuration will increase the number of parts and the costs.

In the above embodiment, the stationary contact is embedded in the inner wall of the case 11. Without being limited to the configuration, it is possible, for example, to employ a configuration such that a plate is disposed in case 11 and a stationary contact is fixed on the plate. However, such configuration will increase the number of parts and the costs.

EXEMPLARY EMBODIMENT 2

Figure 7:
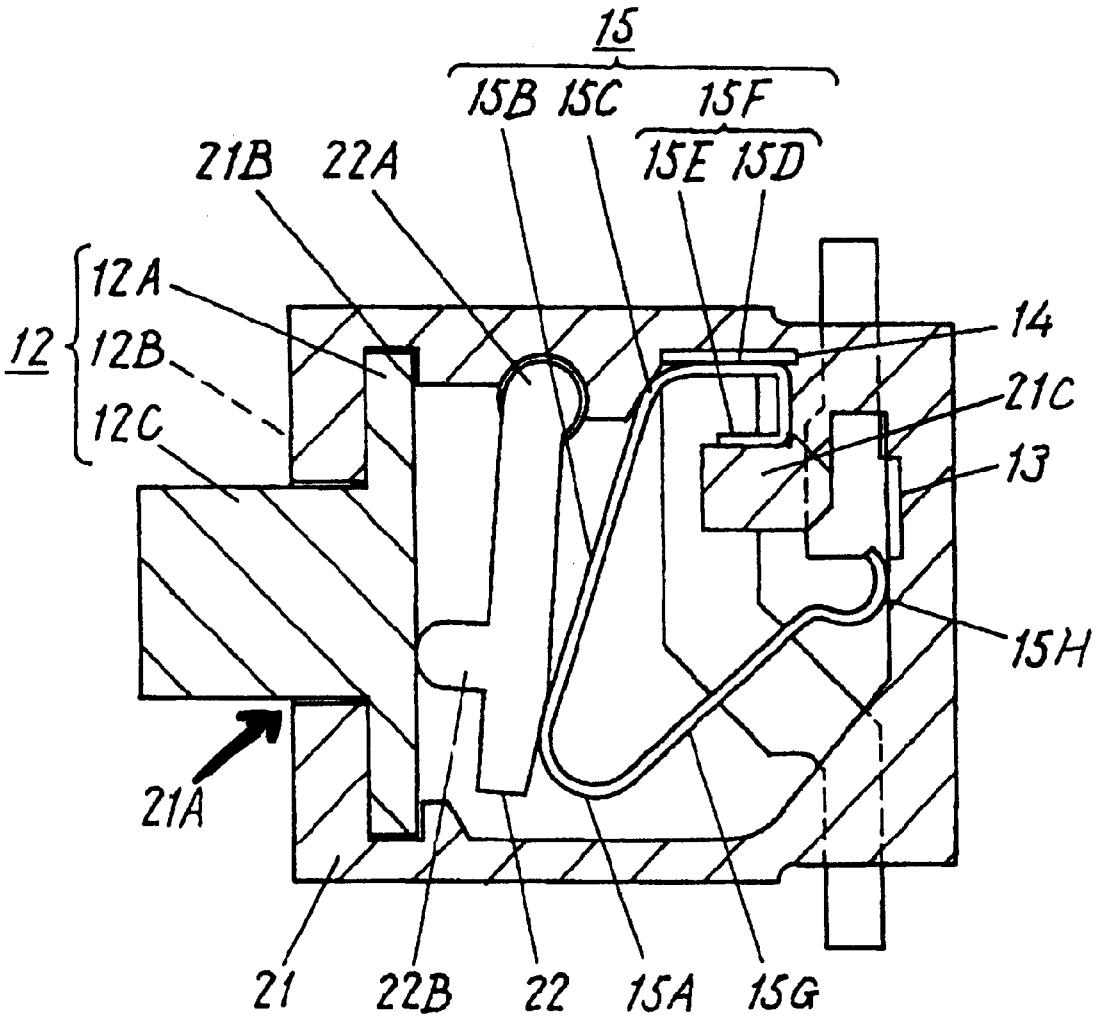
FIG. 7 is a top sectional view of a lever switch in a second exemplary embodiment of the present invention.
Figure 8:
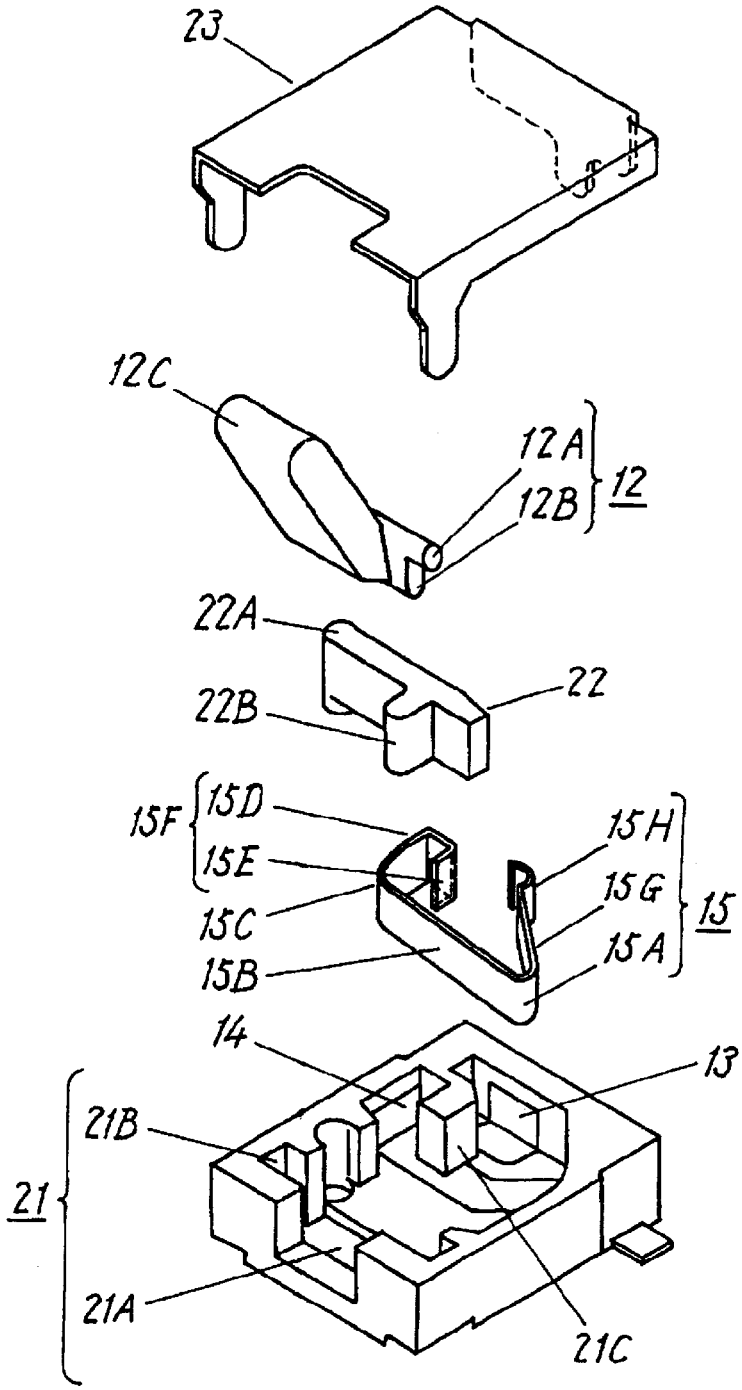
FIG. 8 is an exploded view of a lever switch in a second exemplary embodiment.
Figure 9:
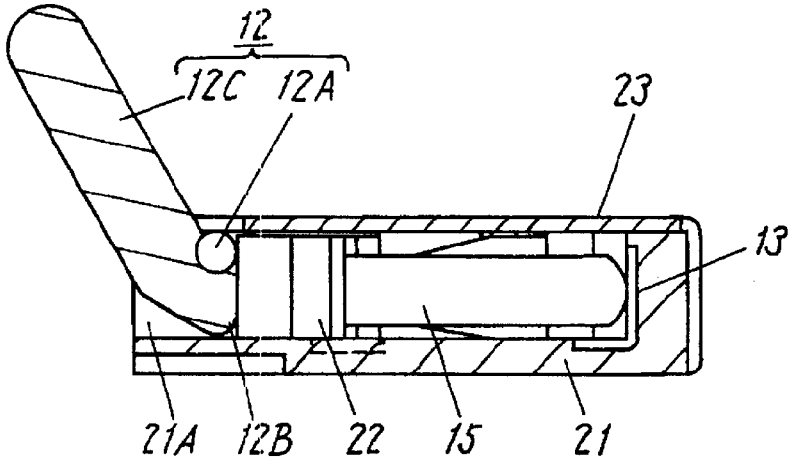
FIG. 9 is a side sectional view of a lever switch in a second exemplary embodiment.

FIG. 7 is a top sectional view of a lever switch in the exemplary embodiment 2 of the present invention, FIG. 8 is an exploded view of same, and FIG. 9 is a side sectional view of same.

In these figures, the lever switch comprises a case 21, a lever 12, a stationary contact 13, a common contact 14, a movable contact 15, and a cover 23. The case 21 is made up of insulating resin. The case 21 has a box-type shape, including a second opening formed in front and a first opening 21A formed at the left-hand side. The lever 12 has an axle portion 12A. The axle portion 12A is formed in the middle of the lever 12. The axle portion 12A is rotatably held by the rotation holding portion 21B of the case 21. A driving portion 12B at one end of the lever 12 is stored in the case 21 and an operating portion 12C at the other end of same is protruded diagonally up to the left from the opening 21A of the case 21.

The stationary contact 13 is made up of conductive metal. The stationary contact 13 is embedded in a right-hand inner wall opposed to the opening 21A of the case 21. The common contact 14 is made up of conductive metal. The common contact 14 is embedded in an upper inner wall. The case 21 has a support portion 21C, and the support portion 21C opposed to the common contact 14 is formed in a position spaced apart from the common contact as predetermined. The above configuration is identical with that of the exemplary embodiment 1.

The movable contact 15 is made up of elastic sheet metal and has a general U-shape. The movable contact 15 is stored in the case 21 in a state of slightly bending. The movable contact 15 comprises a curved portion 15A, first arm portion 15B, bend 15C, stationary portion 15F, second arm portion 15G and contact portion 15H. The stationary portion 15F includes a connecting portion 15D and abutment 15E. The first arm portion 15B extends from one end of the curved portion 15A. At the end of the first arm portion 15B is formed the stationary portion 15F via the bend 15C, and the stationary portion 15F has a general U-shape. The connecting portion 15D elastically comes in contact with the common contact 14, and the abutment 15E elastically comes in contact with the support portion 11C of the case 11 while the stationary portion 15F being in a state of slightly bending is press-fitted between the common contact 14 and the support portion 11C. Such configuration is also identical with that of the above exemplary embodiment 1.

The present exemplary embodiment 2 is different from the above exemplary embodiment 1 in the following points. A lever switch in the present exemplary embodiment 2 further includes a rotary cam 22.

The rotary cam 22 is disposed between the lever 12 and the movable contact 15. The rotary cam 22 includes a fulcrum portion 22A, and the fulcrum portion 22A is formed at the top end of the rotary cam 22. The fulcrum portion 22A of the rotary cam 22 is rotatably retained in the case 21.

The driving portion 12B of the lever 12 elastically comes in contact with a projection 22B at the left-hand side of rotary cam 22, and the curved portion 15A of the movable contact 15 elastically comes in contact with the right-hand side of rotary cam 22. At the end of the second arm portion 15G is formed the contact portion 15H. The contact portion 15H elastically comes in contact with the right-hand inner wall of the case 11. The cover 23 is disposed so as to cover the front of the case 21. The lever 12 supported on axle portion 12A is retained in the case 21 and can be vertically operated in a parallel fashion with the right-hand inner wall of the case 21. Thus, the lever switch has a configuration as described.

Figure 10:
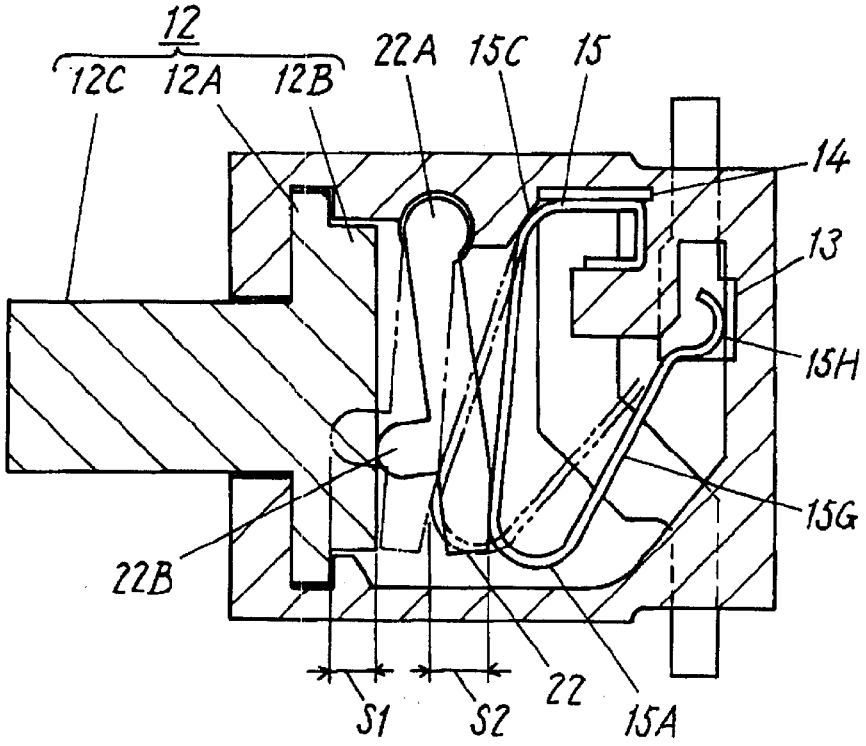
FIG. 10 is a top sectional view of a lever switch in operation mode in a second exemplary embodiment.

In the above configuration, when the operating portion 12C of the lever 12 is rotated downward with a predetermined force in FIG. 9, the driving portion 12B supported on the axle 12A will move to the right as shown in the top sectional view of FIG. 10. The driving portion 12B pushes the projection 22B at the left-hand side of the rotary cam 22. As the projection 22B is pushed, the rotary cam 22 supported on the fulcrum portion 22A moves to the right.

Thus, the curved portion 15A of the movable contact 15 is pushed by the right-hand side of rotary cam 22. As the curved portion is pushed, the movable contact 15 supported on the bend 15C bends and moves to the right in a direction perpendicular to the operating direction of operating portion 12C. Accordingly, the contact portion 15H at the end of the second arm portion 15G elastically slides on the right-hand inner wall of the case 21 in the upward direction and then comes into contact with the stationary contact 13. In this way, the stationary contact 13 and common contact 14 will be electrically connected to each other via the movable contact 15.

At that time, since the rotary cam 22 rotates on the fulcrum portion 22A, the movement S2 of the rotary cam 22 will become greater than the movement S1 of the driving portion 12B of the lever 12 which is moved rightward. The curved portion 15A of the movable contact 15 is pushed for the amount of movement S2, causing the contacts to come into contact with each other.

When the operating force to the operating portion 12C of the lever 12 is released, the contact portion 15H elastically slides downward on the right-hand inner wall of the case 21 due to the elasticity of the movable contact 15 and comes apart from the stationary contact 13. Further, the curved portion 15A pushes the right-hand side of rotary cam 22 to move it to the left, then the projection 22B pushes the driving portion 12B. This operation causes the lever 12 to be rotated and then the operating portion 12C will return to the status of FIG. 7 and FIG. 9.

Due to the configuration of the exemplary embodiment 2, even when the driving portion 12B of the lever 12 is small in size and less in movement, the movable contact 15 is precisely operated by the rotary cam 22. Accordingly, it is possible to obtain a switch reduced in thickness and size.

Figure 11:
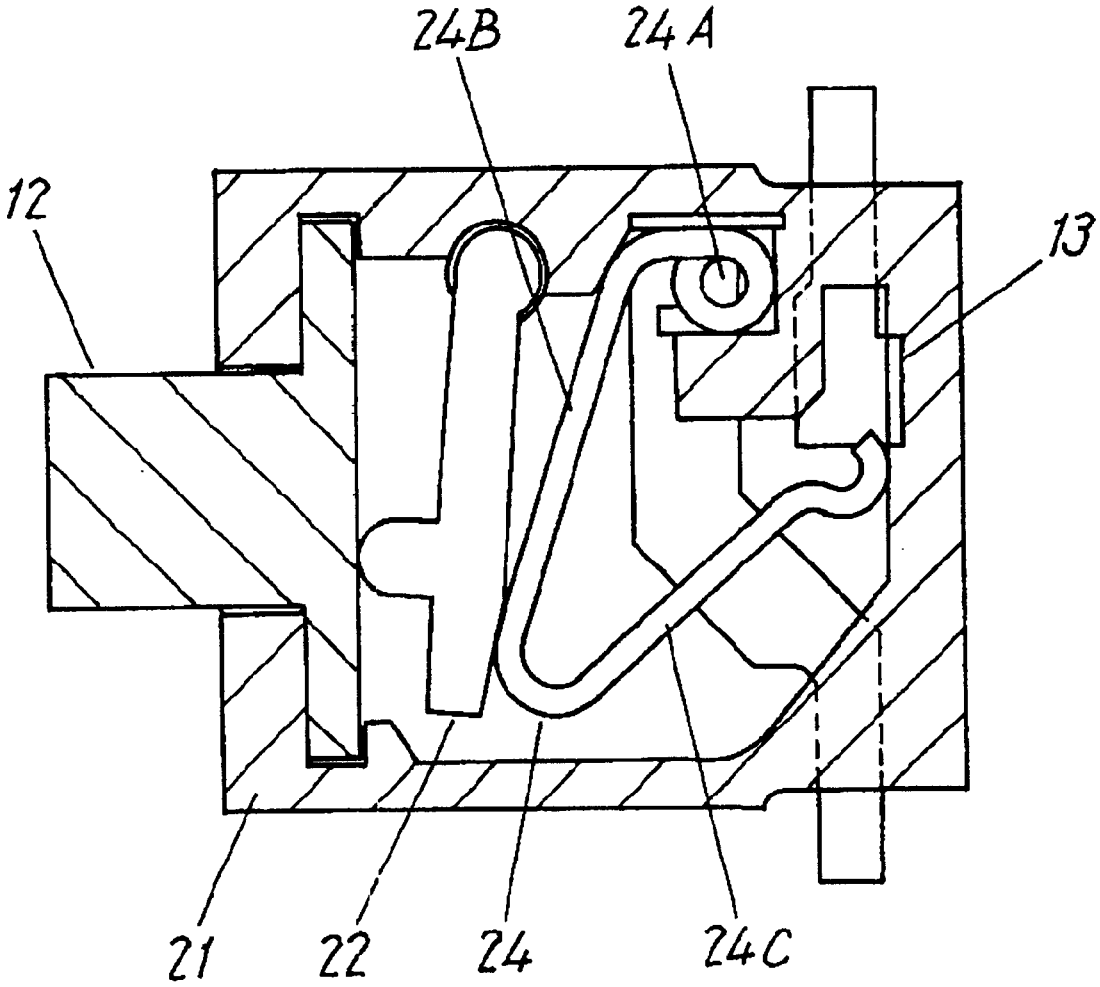
FIG. 11 is a top sectional view of a lever switch having wire material as a movable contact in a second exemplary embodiment.

Also, preferably, in the above configuration, as shown in the top sectional view of FIG. 11, movable contact 24 includes a wire material, and stationary portion 24A includes an unwinding coil spring. In this configuration, even when first arm portion 24B and second arm portion 24C of the movable contact 24 are short in length, the movable contact will be able to keep a sufficient contact pressure and return force to the stationary contact 13 because of the unwinding coil spring 24A. Accordingly, it is possible to reduce the size of the movable contact 24 and further to obtain a switch reduced in thickness and size.

Incidentally, such wire-type movable contact is also usable for a lever switch in the exemplary embodiment 1 described above, but the advantages obtained will be a little less as compared with the exemplary embodiment 2.

Figure 12:
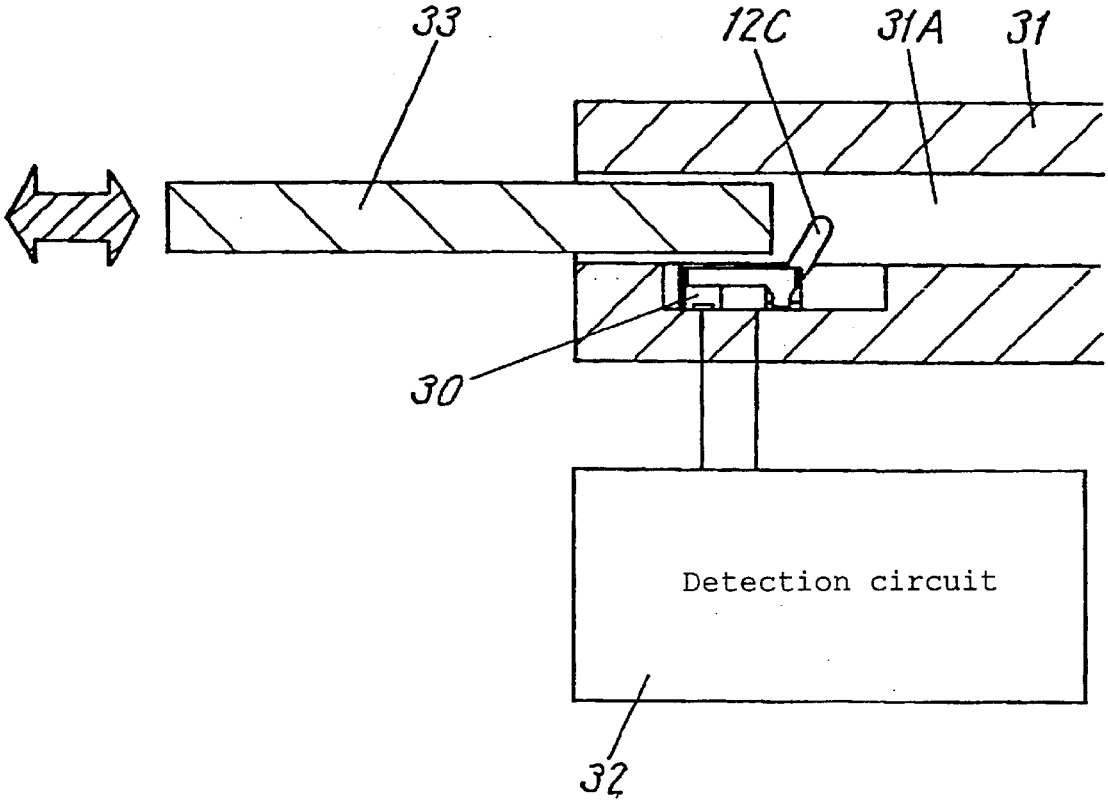
FIG. 12 is a side sectional view of a lever switch in a third exemplary embodiment.
Figure 13:
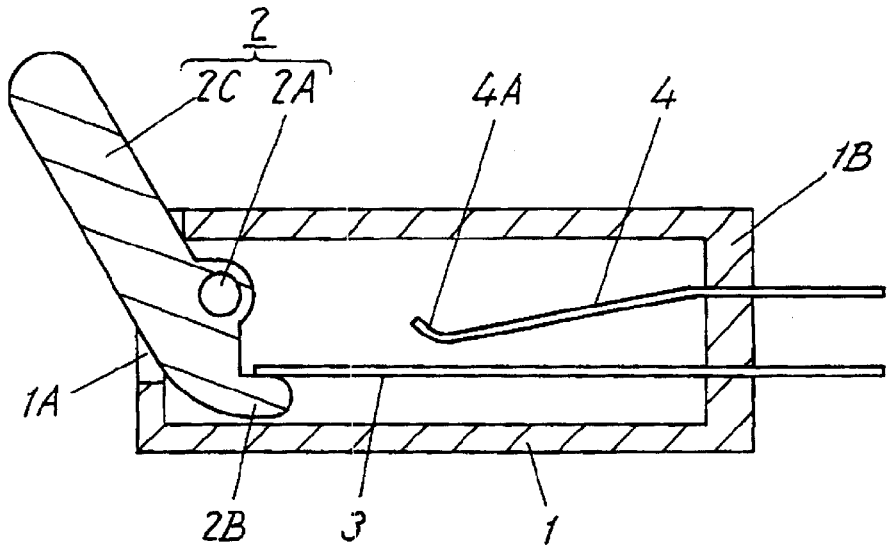
Fig. 13 PRIOR ART
FIG. 13 is a side sectional view of a conventional lever switch.
Figure 14:
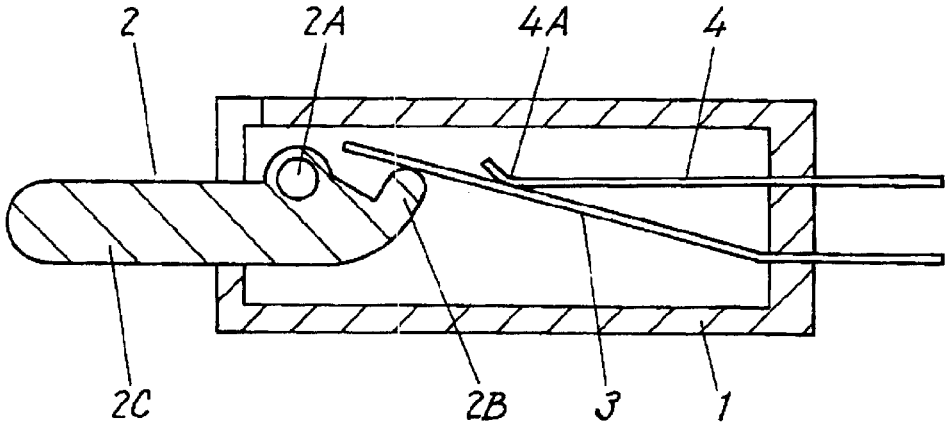
Fig. 14 PRIOR ART
FIG. 14 is a side sectional view of a conventional lever switch in operation mode.

EXEMPLARY EMBODIMENT 3:

FIG. 12 is a side sectional view of a detecting device in the exemplary embodiment 3 of the present invention. In FIG. 12, the detecting device comprises a lever switch 30, electronic equipment casing 31, moving body 33 and detection circuit 32. The lever switch 30 includes a lever switch as described in the above exemplary embodiments 1 or 2. The lever switch 30 is disposed at the bottom of cavity 31A of the casing 31, and the detection circuit 32 is connected to the stationary contact and common contact of the lever switch.

The moving body 33 includes a recording medium such as a tape and disc or a mechanism or the like such as a cam and shaft. When the moving body 33 is inserted into or removed from the cavity 31A of the casing 31, the operating portion 12C of lever switch 30 will be pressed.

In the above configuration, the lever switch 30 is operated when the moving body 33 is inserted into or removed from the cavity 31A of the casing 31. The detection circuit 32 detects the electrical connection and disconnection of the lever switch 30. Thus, whether the moving body 33 is in the cavity 31A of casing 31 may be detected. Further, the movement of the moving body 33 and the operation of the mechanism or the like may also be detected.

For the moving body, a magnetic recording medium such as a cassette tape and disc, optical recording medium and mechanism are employed as a moving body.

A detecting device in the present exemplary embodiment comprises a lever switch 30 reduced in thickness and capable of assuring stable contact. Due to miniaturization of the lever switch, the purpose of miniaturizing the detecting device will be achieved. That is, it becomes possible to detect the presence of a recording medium and the operation of a mechanism or the like. Further , it is possible to realize a detecting device reduced in thickness and size.

As described above, with the configuration of the present invention, it is possible to obtain a miniaturized lever switch. Further, a lever switch which assures electrically stable contact may be obtained. Thus, the purposes of both miniaturization and stabilization may be achieved at the same time. In addition, a detecting device using the lever switch may be reduced in size and thickness. Also, the detecting device is able to reliably detect the operation of the moving body.

What is claimed is:

1. A lever switch, comprising;

(a) a case having an opening, (b) a stationary contact disposed in said case and electrically connected to a first electrical pathway outside of said case, (c) a common contact disposed in said case and electrically connected to a second electrical pathway outside of said case, (d) a movable contact disposed in said case, in which said movable contact is made of elastic metal, said movable contact includes a stationary portion which is stationary relative to said case and which touches said common contact, a contact portion, and a curved portion located between said stationary portion and said contact portion, said stationary portion is connected to said common contact, and said contact portion of said movable contact is movable to come in contact with said stationary contact responsive to force applied on said curved portion, and (e) a lever for applying force on said curved portion.

2. The lever switch as defined in claim 1, wherein said case further comprises a box-type shape having a first inner wall opposed to said opening and a second inner wall adjacent to said first inner wall;

said stationary contact is disposed on said first inner wall; and said common contact is disposed on said second inner wall.

3. The lever switch as defined in claim 1, wherein said case further comprises a support portion and a second inner wall;

said support portion is formed at a position spaced apart from said second inner wall;

said stationary portion includes a small U-shape having a connecting portion and abutment; and said connecting portion is connected to said common contact, and a stationary portion having said small U-shape is disposed between said common contact and said support portion.

4. The lever switch as defined in claim 1, wherein said movable contact includes a general U-shape;

said movable contact further comprises a first arm portion between said stationary portion and said curved portion, and a second arm portion between said contact portion and said curved portion;

when said driving portion pushes said curved portion, at least one of said first arm portion and said second arm portion will bend; and due to bending of at least one of said first arm portion and said second arm portion, said contact portion comes into contact with or apart from said stationary contact.

5. The lever switch as defined in claim 4, wherein said movable contact further includes a tongue that includes elastic materials extending from said stationary portion, and said tongue is abutting on said first arm portion so that a tip of said tongue pushes said first arm portion.

6. The lever switch as defined in claim 4, wherein said movable contact further comprises a tongue that includes elastic materials having a general U-shape and extending from said stationary portion, and said tongue is abutting on said second arm portion so that a tip of said tongue pushes said second arm portion.

7. The lever switch as defined in claim 1, wherein said lever includes an operating portion protruding from said case and a driving portion for applying said force to said curved portion, wherein said lever further comprises an axle portion between said operating portion and said driving portion, and said axle portion is rotatably retained in said case in a parallel fashion with said stationary contact.

8. The lever switch as defined in claim 1, wherein said movable contact has a shape of thin strip;

said contact portion has a semi-circular curvature surface; and said curvature surface is able to make contact with said stationary contact.

9. The lever switch as defined in claim 1, wherein said stationary contact is built into the inner wall of said case so that a surface of said stationary contact is same in height as the inner wall surface of said case, and when said operating portion is manipulated, said contact portion will slide on at least one of the stationary contact surface and the inner wall surface.

10. The lever switch as defined in claim 1, further comprising a cover;

wherein said case includes a first opening from which said lever protrudes;

said case is formed in one piece; and said cover is disposed so as to cover said second opening.

11. The lever switch as defined in claim 1, wherein said case further includes a rotation holding portion, and said lever is rotatably held by said rotation holding portion.

12. The lever switch as defined in claim 1, further comprising a rotary cam disposed between said lever and said movable contact;

wherein one end of said rotary cam is rotatably retained in said case;

a surface of said rotary cam comes in contact with a driving portion of said lever;

a back surface of said rotary cam comes in contact with said curved portion of said movable contact; and when said operating portion is manipulated, said driving portion pushes said rotary cam while said rotary cam with its end retained as described pushes said curved portion, and then, said contact portion comes into contact with or apart from said stationary contact.

13. The lever switch as defined in claim 12, wherein said rotary cam has a projection formed thereon, and said projection comes into contact with said driving portion of said lever.

14. The lever switch as defined in claim 1, wherein said movable contact has a wire shape, and said stationary portion includes a pivotable portion.

15. A detecting device, comprising:

a casing;

a lever switch, comprising;

(a) a case having an opening, (b) a stationary contact disposed in said case and electrically connected to a first electrical pathway outside of said case, (c) a common contact disposed in said case and electrically connected to a second electrical pathway outside of said case, (d) a movable contact disposed in said case, in which said movable contact is made of elastic metal, said movable contact includes a stationary portion which is stationary relative to said case and which touches said common contact, a contact portion, and a curved portion located between said stationary portion and said contact portion, said stationary portion is connected to said common contact, and said contact portion of said movable contact is movable to come in contact with said stationary contact responsive to force applied on said curved portion, and (e) a lever for applying force on said curved portion.

a detection circuit electrically connected to said lever switch; and a moving body inserted and detachably disposed in said casing so as to operate said operating portion of said lever, wherein when said moving body is inserted into said casing, said moving body acts upon said operating portion of said lever.

16. A detecting device as defined in claim 15, wherein said moving body includes at least one of those selected from a group of a cassette tape and a disc and mechanism.

17. A lever switch, comprising:

(a) a case having an opening and a support portion, in which said case has a box-type shape including a first inner wall opposed to said opening and a second inner wall adjacent to said first inner wall, and said support portion is formed at a position spaced apart from said second inner wall;

(b) a stationary contact disposed within said case, in which said stationary contact is installed on said first inner wall;

(c) a common contact disposed within said case, in which said common contact is installed on said second inner wall;

(d) a movable contact disposed in a state of bending within said case, in which said movable contact is made of elastic sheet metal and has a general U-shape, said movable contact includes a stationary portion secured to said case, a contact portion, a curved portion between said stationary portion and said contact portion, a first arm portion between said stationary portion and said curved portion, and a second arm portion between said contact portion and said curved portion, said contact portion is able to come in contact with at least one of said stationary contact and said first inner wall, said stationary portion has a small U-shape and is press-fitted between said common contact and said support portion, and said stationary portion comes into contact with said common contact; and (e) a lever having an operating portion, an axle portion and a driving portion, in which said operating portion is protruded from said opening, said axle portion is rotatably retained in said case in a parallel fashion with said stationary contact, and said driving portion is located in said case and is abutting on said curved portion of said movable contact;

wherein when said operating portion is manipulated, said driving portion pushes said curved portion, and then, said contact portion comes into contact with or apart from said stationary contact.

18. The lever switch as defined in claim 17, wherein said movable contact further includes a tongue that includes elastic materials extending from said stationary portion, and said tongue is abutting on said first arm portion so that the tip of said tongue pushes said first arm portion.

19. The lever switch as defined in claim 17, wherein said movable contact further includes a generally U-shaped tongue that includes elastic materials extending from said stationary portion, and said tongue is abutting on said second arm portion so that a tip of said tongue pushes said second arm portion.

20. The lever switch as defined in claim 17, further comprising:

a rotary cam disposed between said lever and said movable contact, wherein one end of said rotary cam is rotatably retained in said case;

a surface of said rotary cam comes in contact with said driving portion of said lever;

a back surface of said rotary cam comes in contact with said curved portion of said movable contact; and when said operating portion is manipulated, said driving portion pushes said rotary cam, and said rotary cam supported on said one end pushes said curved portion, and then, said contact portion comes in contact with or apart from said stationary contact.

21. The lever switch as defined in claim 17, wherein said movable contact has a wire shape, and said stationary portion includes a pivotable portion.

22. A lever switch as defined in claim 17, said lever switch included in a detecting device, said detecting device comprising:

a casing;

a detection circuit electrically connected to said lever switch; and a moving body inserted and detachably disposed in said casing so as to operate said operating portion of said lever, wherein when said moving body is inserted into said casing, said moving body acts upon said operating portion of said lever.

* * * * *